US011556075B2

(12) United States Patent
Kasuya et al.

(10) Patent No.: US 11,556,075 B2
(45) Date of Patent: Jan. 17, 2023

(54) LIGHT EMITTING DEVICE AND RENDERING DEVICE INCLUDING A FLOW PATH

(71) Applicant: FUJIFILM Business Innovation Corp., Tokyo (JP)

(72) Inventors: Yosuke Kasuya, Kanagawa (JP); Tsutomu Otsuka, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 177 days.

(21) Appl. No.: 17/077,195

(22) Filed: Oct. 22, 2020

(65) Prior Publication Data

US 2021/0302864 A1 Sep. 30, 2021

(30) Foreign Application Priority Data

Mar. 25, 2020 (JP) ..... JP2020-054936

(51) Int. Cl.
*G03G 15/04* (2006.01)
*B41J 2/45* (2006.01)

(52) U.S. Cl.
CPC ..... *G03G 15/04054* (2013.01); *B41J 2/451* (2013.01)

(58) Field of Classification Search
USPC ..... 257/79
See application file for complete search history.

(56) References Cited

U.S. PATENT DOCUMENTS 9,981,482 B2 5/2018 Tanaka
2008/0175605 A1* 7/2008 Sakurai ..... G03G 15/326 313/504
2016/0070230 A1* 3/2016 Kokubu ..... G03G 21/206 399/92

FOREIGN PATENT DOCUMENTS

CN 1082201 C * 4/2002 ..... G03G 15/0258
JP 2017-177664 A 10/2017

* cited by examiner

*Primary Examiner* — Quana Grainger
(74) *Attorney, Agent, or Firm* — Sughrue Mion, PLLC

(57) ABSTRACT

A light emitting device, includes: a base plate extending in a first direction; multiple light emitting units arranged on a surface of the base plate while being shifted from each other in the first direction, and each including a support body extending in the first direction and multiple light sources supported on the support body while being arranged in the first direction; and a flow path disposed over the surface of the base plate to surround at least part of the light emitting units and allowing air to flow therethrough in the first direction.

11 Claims, 10 Drawing Sheets

LIGHT EMITTING DEVICE AND RENDERING DEVICE INCLUDING A FLOW PATH

CROSS-REFERENCE TO RELATED APPLICATIONS

This application is based on and claims priority under 35 USC 119 from Japanese Patent Application No. 2020-054936 filed Mar. 25, 2020.

BACKGROUND

(i) Technical Field

The present disclosure relates to a light emitting device and a rendering device.

(ii) Related Art

Japanese Unexamined Patent Application Publication No. 2017-177664 discloses a light exposure device that includes a first light exposure head and a second light exposure head. The first light exposure head includes multiple first light emitting devices, which are arranged in a first direction to emit first light beams, a first optical system, which is disposed to face the multiple first light emitting devices in a second direction crossing the first direction and forms the multiple first light beams emitted from the multiple first light emitting devices into images, a first joint, and a first base plate that supports the multiple first light emitting devices, the first optical system, and the first joint. The second light exposure head includes multiple second light emitting devices, which are arranged in the first direction to each emit second light beams, a second optical system, which is disposed to face the multiple second light emitting devices in the second direction to form the multiple second light beams emitted from the multiple second light emitting devices into images, a second joint that fits to the first joint, and a second base plate that supports the multiple second light emitting devices, the second optical system, and the second joint. In the light exposure device, the first joint is located on the first base plate at a first position corresponding to an imaging position of the first optical system, and the second joint is located on the second base plate at a second position corresponding to an imaging position of the second optical system.

SUMMARY

Aspects of non-limiting embodiments of the present disclosure relate to a light emitting device and a rendering device in which the light emitting device has a smaller width than a structure including a passage disposed on an outer side of a base plate in the width direction.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a light emitting device, includes: a base plate extending in a first direction; multiple light emitting units arranged on a surface of the base plate while being shifted from each other in the first direction, and each including a support body extending in the first direction and multiple light sources supported on the support body while being arranged in the first direction; and a flow path disposed over the surface of the base plate to surround at least part of the light emitting units and allowing air to flow therethrough in the first direction.

BRIEF DESCRIPTION OF THE DRAWINGS

Exemplary embodiments of the present disclosure will be described in detail based on the following figures, wherein.

DETAILED DESCRIPTION

Hereinbelow, forms embodying the present disclosure (referred to as exemplary embodiments, below) will be described.

First Exemplary Embodiment

Image Forming Apparatus 10

Figure 1:
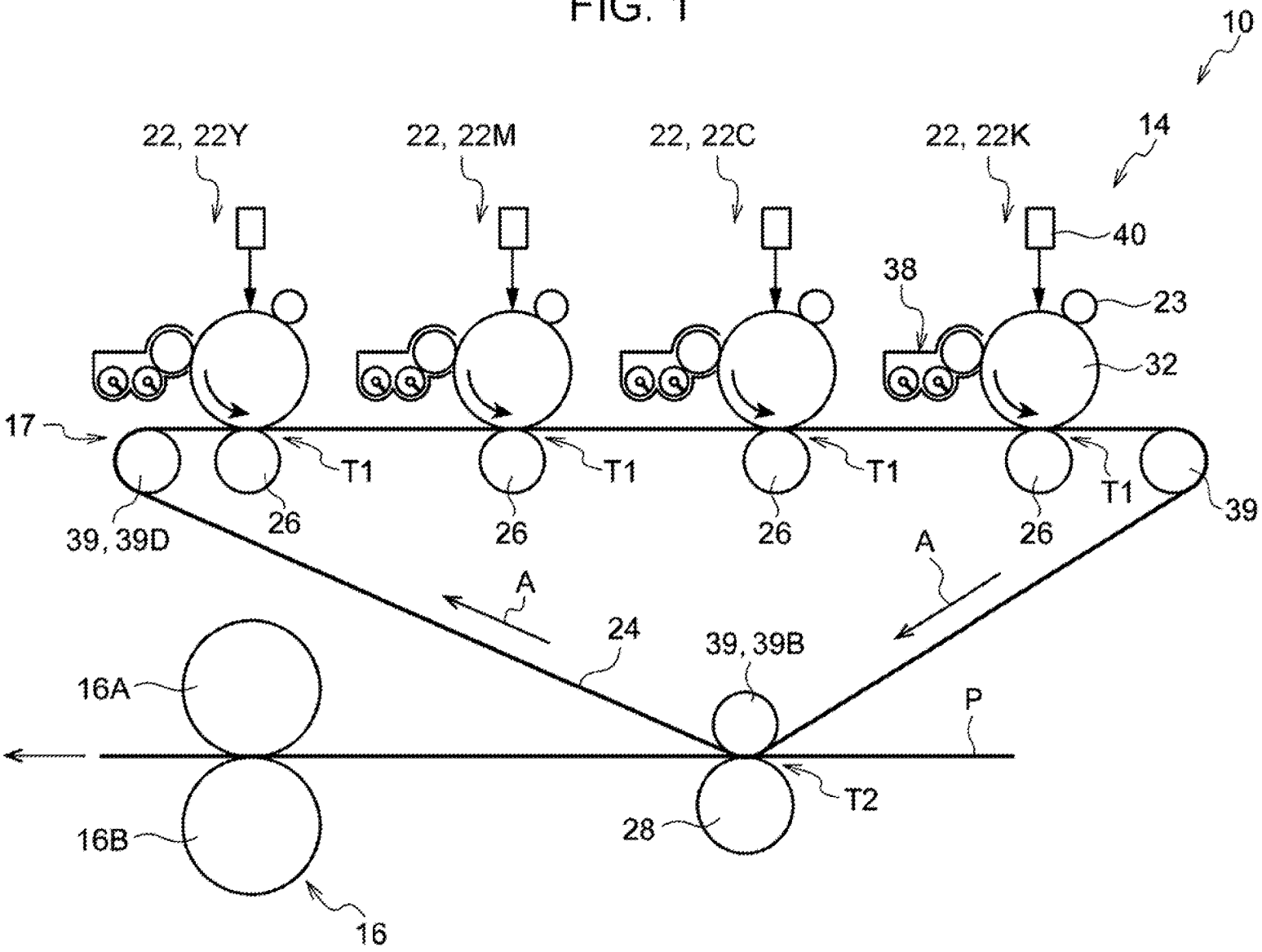
FIG. 1 is a schematic diagram of an image forming apparatus including a light exposure device according to a first exemplary embodiment.

FIG. 1 is a schematic diagram of a structure of an image forming apparatus 10 including light exposure devices 40 according to a first exemplary embodiment. First, the structure of the image forming apparatus 10 will be described. Subsequently, the light exposure devices 40 included in the image forming apparatus 10 will be described. Here, the image forming apparatus 10 is an example of a rendering device, and each light exposure device 40 is an example of a light emitting device. The image forming apparatus 10 is, for example, an image forming apparatus forming images with multiple colors, and is, for example, a full-color printer for commercial printing requiring high quality in particular.

The image forming apparatus 10 is a wide image forming apparatus that handles a width exceeding the width of a recording medium P in B3 longitudinal feed (that is, width exceeding 364 mm). For example, the image forming apparatus 10 handles a recording medium P with 420 mm or greater in A2 longitudinal feed and with 1456 mm or smaller in BO cross feed. For example, the image forming apparatus 10 handles 728 mm in B2 cross feed.

The image forming apparatus 10 illustrated in FIG. 1 is an example of an image forming apparatus that forms an image on a recording medium. Specifically, the image forming apparatus 10 is an electrophotographic image forming apparatus that forms a toner image (example of an image) on a recording medium P. Toner is an example of powder. More specifically, the image forming apparatus 10 includes an image forming unit 14 and a fixing device 16. Hereinbelow, each components of the image forming apparatus 10 (the image forming unit 14 and the fixing device 16) will be described.

Image Forming Unit 14

The image forming unit 14 has a function of forming a toner image on the recording medium P. Specifically, the image forming unit 14 includes toner image forming units 22 and a transfer device 17.

Toner Image Forming Units 22

The multiple toner image forming units 22 illustrated in FIG. 1 form images of respective colors. The present exemplary embodiment includes four toner image forming units 22 for yellow (Y), magenta (M), cyan (C), and black (K). In FIG. 1, Y, M, C, and K appended to the reference signs correspond to components for the respective colors.

The toner image forming units 22 for the respective colors have the same structure excluding the toner used in each unit. Thus, components of the toner image forming unit 22K are denoted with reference signs in FIG. 1 as a representative of the toner image forming units 22Y, 22M, 22C, and 22K for the respective colors.

Each of the toner image forming units 22 for the respective colors specifically includes a photoconductor drum 32, which rotates in the first direction (for example, counterclockwise in FIG. 1). Here, the photoconductor drum 32 is an example of a cylindrical member, and a photoconductor on the surface of the photoconductor drum 32 is an example of an area over which a photoconductor material is disposed. Each of the toner image forming units 22 for the respective colors also includes a charging device 23, a light exposure device 40, and a developing device 38.

In each of the toner image forming units 22 for the respective colors, the charging device 23 electrically charges the photoconductor drum 32. The light exposure device 40 exposes the photoconductor drum 32 electrically charged by the charging device 23 to light to form an electrostatic latent image on the photoconductor drum 32. The developing device 38 develops an electrostatic latent image formed on the photoconductor drum 32 by the light exposure device 40 into a toner image.

The photoconductor drum 32 rotates while carrying the electrostatic latent image thus formed on its outer circumference to transport the electrostatic latent image to the developing device 38. A specific structure of the light exposure device 40 will be described later.

Transfer Device 17

The transfer device 17 illustrated in FIG. 1 is a device that transfers the toner image formed by each toner image forming unit 22 to a recording medium P. Specifically, the transfer device 17 first-transfers the toner images on the photoconductor drums 32 for the respective colors onto a transfer belt 24, serving as an intermediate transfer body, in a superposed manner, and second-transfers the superposed toner images to the recording medium P. Specifically, as illustrated in FIG. 1, the transfer device 17 includes the transfer belt 24, first transfer rollers 26, and a second transfer roller 28.

Each first transfer roller 26 is a roller that transfers the toner image on the corresponding photoconductor drum 32 to the transfer belt 24 at a first transfer position T1 between the photoconductor drum 32 and the first transfer roller 26. In the present exemplary embodiment, a first transfer electric field is imposed between the first transfer roller 26 and the photoconductor drum 32, so that the toner image on the photoconductor drum 32 is transferred to the transfer belt 24 at the first transfer position T1.

The transfer belt 24 has an outer peripheral surface that receives toner images from the respective photoconductor drums 32. Specifically, the transfer belt 24 has the following structure. As illustrated in FIG. 1, the transfer belt 24 is annular and fixed in position while being wound around multiple rollers 39.

The transfer belt 24 rotates in the direction of arrows A by, for example, a driving roller 39D among the multiple rollers 39 being driven to rotate by a driving unit (not illustrated). A roller 39B among the multiple rollers 39 illustrated in FIG. 1 is an opposing roller 39B, which opposes the second transfer roller 28.

The second transfer roller 28 is a roller that transfers the toner images transferred to the transfer belt 24 to the recording medium P at a second transfer position T2 between the opposing roller 39B and the second transfer roller 28. In the present exemplary embodiment, a second transfer electric field is imposed between the opposing roller 39B and the second transfer roller 28, so that the toner image transferred to the transfer belt 24 is transferred to the recording medium P at the second transfer position T2.

Fixing Device 16

The fixing device 16 illustrated in FIG. 1 is a device that fixes a toner image transferred to the recording medium P by the second transfer roller 28 onto the recording medium P. Specifically, as illustrated in FIG. 1, the fixing device 16 includes a heating roller 16A, serving as a heating member, and a pressing roller 16B, serving as a pressing member. The fixing device 16 heats and presses the recording medium P with the heating roller 16A and the pressing roller 16B to fix the toner image formed on the recording medium P onto the recording medium P.

Light Exposure Device 40

Figure 2:
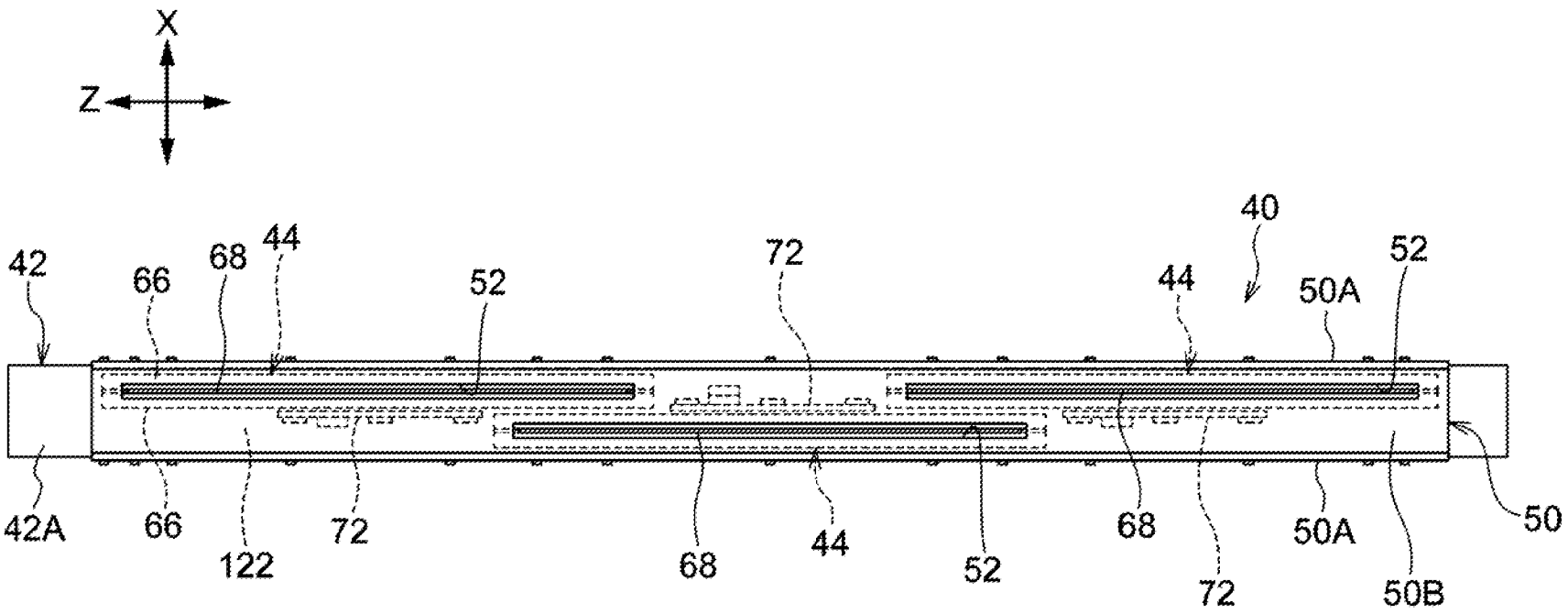
FIG. 2 is a diagram of a structure of a light exposure device included in an image forming apparatus, viewed from above.
Figure 3:
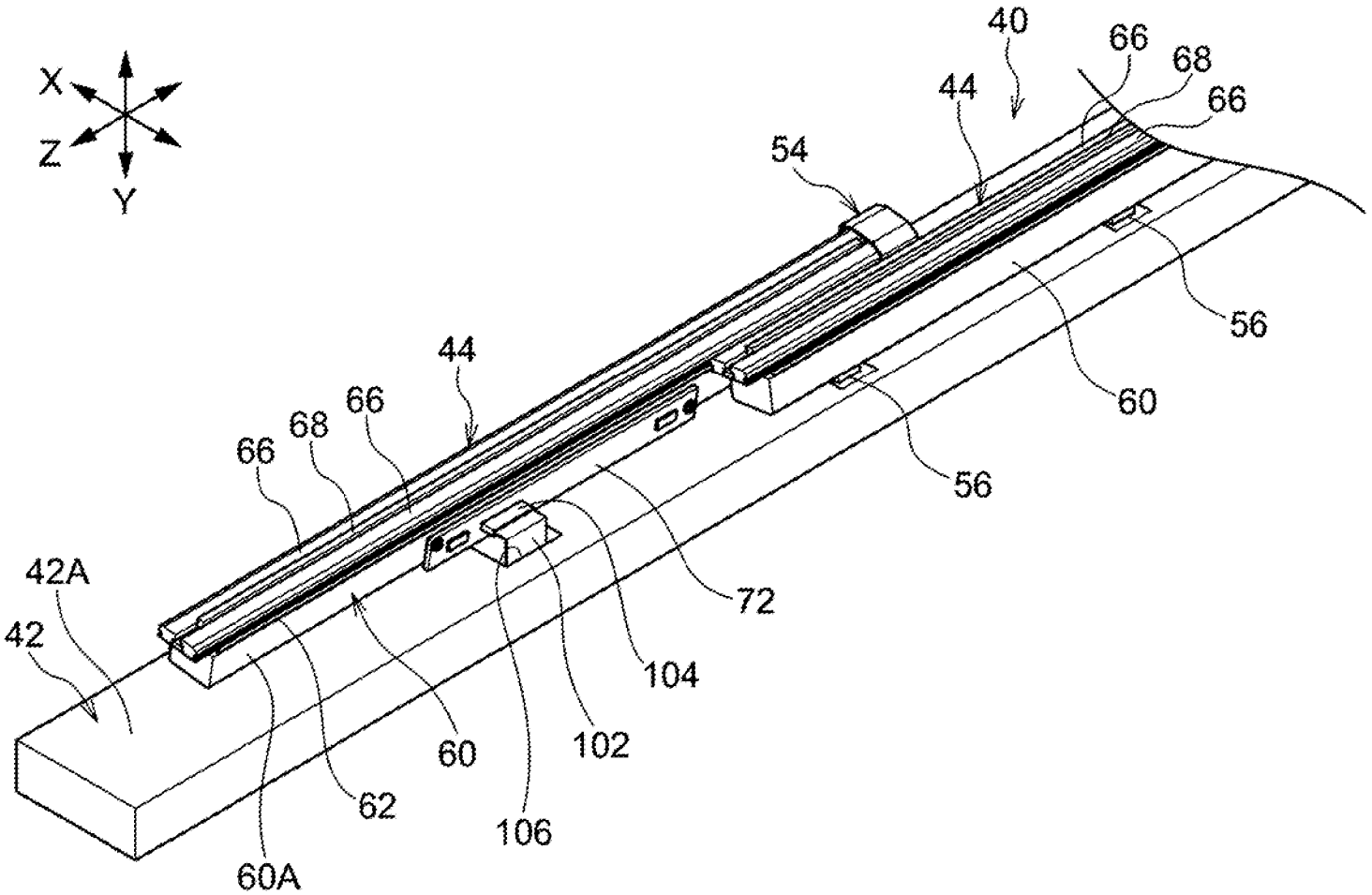
FIG. 3 is a perspective view of part of a light exposure device.

Subsequently, the structure of each light exposure device 40, which is a related portion of the present exemplary embodiment, will be described. FIG. 2 is a plan view of the light exposure device 40 viewed in the vertical direction. FIG. 3 is a perspective view of a portion of the light exposure device 40. In the following description, the direction of arrow X in the drawings is described as a width direction of the light exposure device 40, and the direction of arrow Y is described as a height direction of the light exposure device 40. The direction of arrow Z perpendicular to the device width direction and the device height direction is described as a depth direction of the light exposure device 40. The width direction and the height direction are defined for ease of illustration, and the structure of the light exposure device 40 is not limited by these directions.

Entire Structure of Light Exposure Device 40

First, the entire structure of each light exposure device 40 will be described, and then, components of the light exposure device 40 will be described.

As illustrated in FIG. 2 and FIG. 3, each light exposure device 40 includes a base plate 42 extending in a first direction (direction of arrow Z in the present exemplary embodiment), and multiple light emitting units 44 disposed on a first side (vertically upper side in FIG. 2 and FIG. 3) of the base plate 42 in the direction of arrow Y. The present exemplary embodiment includes three light emitting units 44 extending in the first direction of the base plate 42. The base plate 42 is a long rectangular member in a plan view in FIG. 2. The light emitting units 44 have the same structure, and are long rectangular members in a plan view in FIG. 2. The length of each light emitting unit 44 in the first direction (that is, longitudinal direction) is smaller than the length of the base plate 42 in the first direction (that is, longitudinal direction).

For example, the three light emitting units 44 are arranged while being shifted from each other in the first direction (direction of arrow Z) of the base plate 42, and being shifted in the width direction perpendicular to the first direction of the base plate 42, that is, shifted in the cross direction (direction of arrow X) of the base plate 42. The light exposure device 40 is disposed to extend in the axial direction of the photoconductor drum 32 (refer to FIG. 1), and the length of the light exposure device 40 in the first direction (direction of arrow Z) is greater than the length of the photoconductor drum 32 in the axial direction. At least one of the three light emitting units 44 opposes the area of the surface of the photoconductor drum 32 over which a photoconductor is disposed. Thus, the surface of the photoconductor drum 32 is irradiated with light emitted from the light exposure device 40.

In FIGS. 2 and 3 and other drawings of the light exposure device 40, the light emitting units 44 on the base plate 42 are located on the vertically upper side to emit light upward. However, in the image forming apparatus 10 illustrated in FIG. 1, the light exposure device 40 is disposed upside down in the vertical direction. Specifically, in FIG. 1, the light exposure device 40 is disposed while having the side of the base plate 42 receiving the light emitting units 44 on the vertically lower side, and having the light emitting units 44 emit light toward the photoconductor drum 32 on the lower side.

In the present exemplary embodiment, the three light emitting units 44 are staggered when viewed from above in the vertical direction of the light exposure device 40 (refer to FIG. 2). More specifically, two light emitting units 44 are arranged at both end portions of the base plate 42 in the first direction (direction of arrow Z) on a first side of the base plate 42 in the cross direction (direction of arrow X). At a middle portion of the base plate 42 in the first direction (direction of arrow Z), one light emitting unit 44 is arranged on a second side of the base plate 42 in the cross direction (direction of arrow X). The end portions of the two light emitting units 44 arranged on the first side of the base plate 42 in the cross direction (direction of arrow X) and the end portions of the one light emitting unit 44 arranged on the second side of the base plate 42 in the cross direction (direction of arrow X) overlap each other when viewed in the cross direction (direction of arrow X) of the base plate 42. Specifically, in the first direction (direction of arrow Z) of the base plate 42, the areas from which the three light emitting units 44 emit light partially overlap.

The two light emitting units 44 arranged on the first side of the base plate 42 in the cross direction (direction of arrow X) and the one light emitting unit 44 arranged on the second side of the base plate 42 in the cross direction (direction of arrow X) do not overlap when viewed in the first direction (direction of arrow Z) of the base plate 42.

Figure 4:
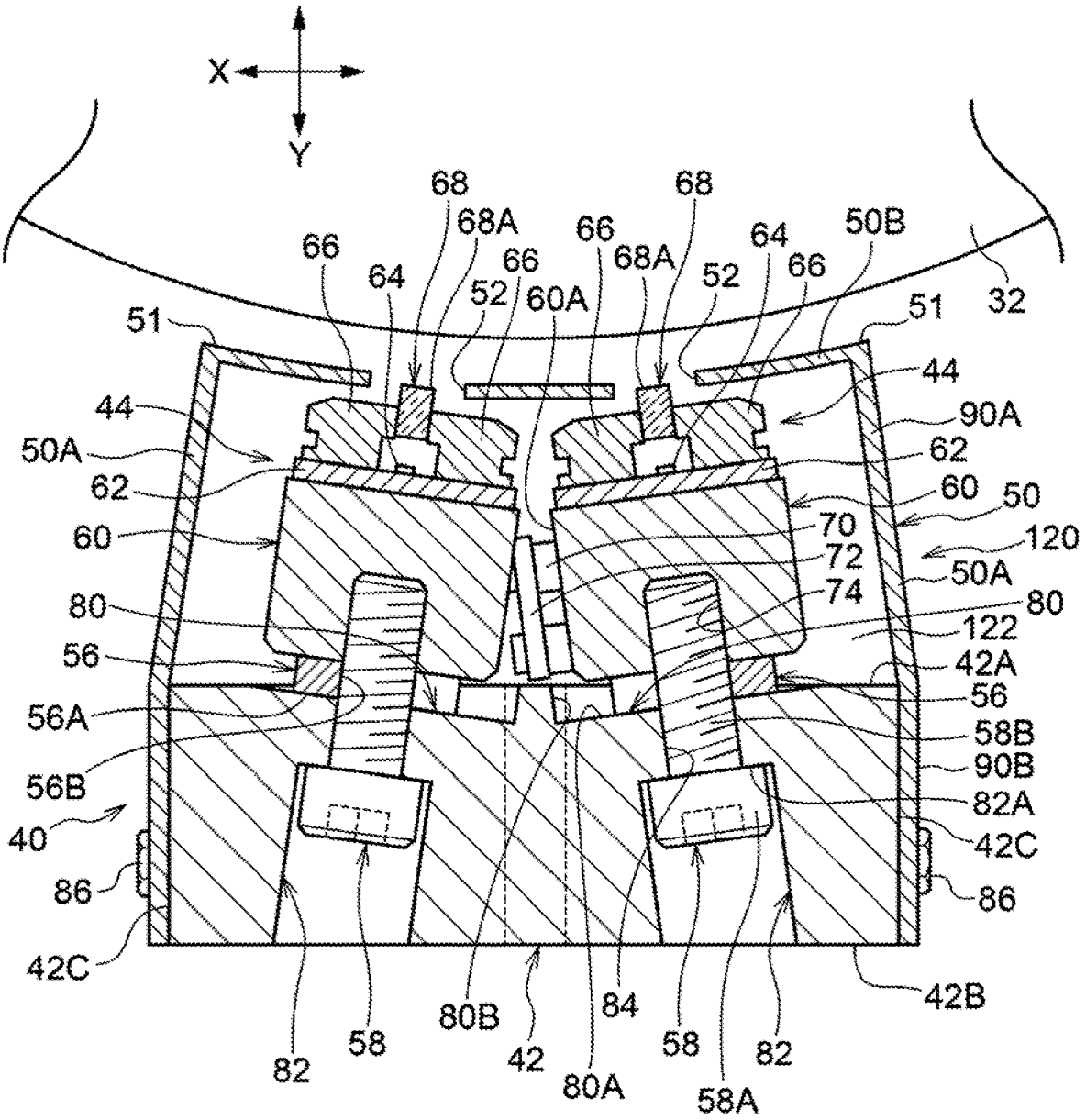
FIG. 4 is a cross-sectional view of a light exposure device taken in a cross direction.

As shown in FIG. 4, the light exposure device 40 includes a covering 50, surrounding the three light emitting units 44 on the base plate 42 and including a flow path 122 therein, and an air feeding device 120, which feeds air to the flow path 122.

As illustrated in FIG. 3, the light exposure device 40 includes cleaning devices 54, which clean lens units 68 of the light emitting units 44. The lens units 68 will be described later. As illustrated in FIG. 4, the light exposure device 40 also includes multiple spacers 56, interposed between the base plate 42 and the light emitting units 44, and fastening members 58, which secure the light emitting units 44 to the base plate 42 while having the multiple spacers 56 interposed therebetween. Examples of the fastening members 58 are members having a helical groove used for fastening. In other words, examples of the fastening members 58 are components having a screw mechanism, and include screws and bolts.

Although not illustrated, at both end portions of the base plate 42 in the first direction (direction of arrow Z), positioning shafts extend vertically upward. The positioning shafts are in contact with bearing members at both ends of the corresponding photoconductor drum 32 to fix the position of the light exposure device 40 in the light irradiation direction with respect to the photoconductor drum 32.

Base Plate 42

As illustrated in FIG. 2 to FIG. 4, the base plate 42 is formed from a thin rectangular prism. The base plate 42 is disposed to oppose the photoconductor drum 32 (FIG. 1) throughout in the axial direction.

In an upper surface 42A of the base plate 42 in the vertical direction (direction of arrow Y), recesses 80 that receive the spacers 56 are formed (refer to FIG. 4). For example, the multiple spacers 56 are arranged for each light emitting unit 44 while being spaced apart from each other in the first direction (direction of arrow Z). For example, three spacers 56 are disposed for each light emitting unit 44.

Each recess 80 includes a slope 80A, forming a bottom surface and inclined with respect to the surface 42A of the base plate 42, a vertical wall 80B, disposed at the downward end of the slope 80A, and two vertical walls (not illustrated) opposing each other at both sides of the slope 80A (refer to FIG. 4). For example, the slopes 80A for the two light emitting units 44 disposed on the first side of the base plate 42 in the cross direction and the slope 80A for the one light emitting unit 44 disposed on the second side of the base plate 42 in the cross direction are inclined in opposite directions. In the light exposure device 40, the slopes 80A inclined in the opposite directions enable the two light emitting units 44 disposed on the first side of the base plate 42 in the cross direction and the one light emitting unit 44 disposed on the second side of the base plate 42 in the cross direction to emit light toward the center portion of the photoconductor drum 32 (refer to FIG. 1).

In the present exemplary embodiment, the base plate 42 is formed from a metal block. The metal block in the present exemplary embodiment refers to a block of metal excluding typical sheet metal shaped by being bent, and that has a shape usable as a base plate of the light exposure device 40 with a thickness that is substantially unbendable. For example, the thickness of the metal block is 10% or higher of the width of the base plate 42. More specifically, the thickness of the metal block may be 20% or higher and 100% or lower of the width of the base plate 42.

An existing wide image forming apparatus is designed for outputting monochrome images without demanding high image quality unlike a full-color printer for commercial printing, and includes sheet metal for use as the base plate. On the other hand, the image forming apparatus 10 according to the exemplary embodiment is a full-color printer for commercial printing, and is supposed to have high image quality. The image forming apparatus 10 thus includes a metal block that is stiffer than sheet metal to reduce the effect of bending of the base plate 42 on the image quality.

The base plate 42 is formed from, for example, steel or stainless steel. The base plate 42 may be formed from a metal block made of a material other than steel or stainless steel. For example, the base plate 42 may be formed from aluminum that is lighter in weight and more highly thermally conductive than steel or stainless steel.

The thickness of the base plate 42 in the vertical direction (direction of arrow Y) is preferably greater than the thickness of support bodies 60 included in the light emitting units 44. Thus, the base plate 42 has stiffness (flexural rigidity in the direction of arrow Y) greater than the stiffness of the light emitting units 44. The thickness of the base plate 42 in the vertical direction (direction of arrow Y) is preferably equal to or greater than 5 mm, more preferably equal to or greater than 10 mm, and further preferably equal to or greater than 20 mm.

As illustrated in FIG. 4, in a back surface 42B of the base plate 42 opposite to the surface 42A, recessed portions 82 are formed to be set back toward the spacers 56, that is, toward the recesses 80. The recessed portions 82 are formed at positions corresponding to the recesses 80 of the base plate 42. The recessed portions 82 extend obliquely toward the middle portion of the base plate 42 in the cross direction (X direction) from the back surface 42B of the base plate 42. For example, the recessed portions 82 are circular when viewed from the back surface 42B of the base plate 42. The recessed portions 82 have an inner diameter greater than the profile of a head 58A of each fastening member 58. In each of bottom surfaces 82A of the recessed portions 82, a through-hole 84 is formed. A shank 58B of each fastening member 58 extends through the base plate 42 through the through-hole 84. Each through-hole 84 is open in the slope 80A of the corresponding recess 80.

Light Emitting Units 44

As illustrated in FIG. 4, the three light emitting units 44 have the same structure, as described above. For example, the two light emitting units 44 on the first side of the base plate 42 in the cross direction (direction of arrow X) and the one light emitting unit 44 on the second side of the base plate 42 in the cross direction (direction of arrow X) are disposed to be symmetrical in the cross direction (direction of arrow X) of the base plate 42.

As illustrated in FIGS. 3 and 4, the light emitting units 44 each include the support body 60 extending in the first direction (direction of arrow Z), and a light-emitting-device substrate 62 supported on the surface of the support body 60 (vertically upper surface in the present exemplary embodiment) opposite, in the vertical direction (direction of arrow Y), to the surface facing the base plate 42. Multiple light sources 64 are mounted on the light-emitting-device substrate 62 to be arranged in the first direction (refer to FIG. 4). In the present exemplary embodiment, each light source 64 includes, for example, multiple light emitting devices. For example, each light source 64 is a light-emitting device array including a semiconductor substrate and multiple light emitting devices arranged on the semiconductor substrate in the first direction. In the present exemplary embodiment, the light-emitting device arrays serving as the light sources 64 are staggered on the light-emitting-device substrate 62 in the first direction. Instead of the light-emitting device array, each light source 64 may be a single light emitting device. Each light emitting device is formed from, for example, a light emitting diode, a light emitting thyristor, or a laser device. The light emitting device has a resolution of, for example, 2400 dpi when arranged in the first direction. The light-emitting-device substrate 62 is a substrate used to allow at least one of the multiple light sources 64 to emit light. FIG. 4 illustrates only one of the light sources 64 of the corresponding light emitting unit 44 without illustrating the other light sources.

Each of the light emitting units 44 includes a pair of mounts 66, disposed on the surface of the light-emitting-device substrate 62 opposite to the surface where the support body 60 is disposed, and the lens unit 68, held while being interposed between upper ends of the pair of mounts 66.

The pair of mounts 66 and the lens unit 68 extend in the first direction (direction of arrow Z) of the support body 60 (refer to FIG. 3). The lens unit 68 is disposed at a position opposing the multiple light sources 64, and the space is left between the lens unit 68 and the multiple light sources 64 (refer to FIG. 4). In the light exposure device 40, light emitted from the multiple light sources 64 is transmitted through the lens unit 68, and applied to the surface of the photoconductor drum 32 (refer to FIG. 1), serving as an irradiation target.

The support body 60 is formed from a rectangular prism. In the present exemplary embodiment, as in the base plate 42, the support body 60 is formed from a metal block. For example, the support body 60 is formed from steel or stainless steel. Here, the support body 60 may be formed from a metal block made of a material other than steel or stainless steel. For example, the support body 60 may be formed from a metal block made of aluminum that is lighter in weight and more highly thermally conductive than steel or stainless steel.

Figure 6:
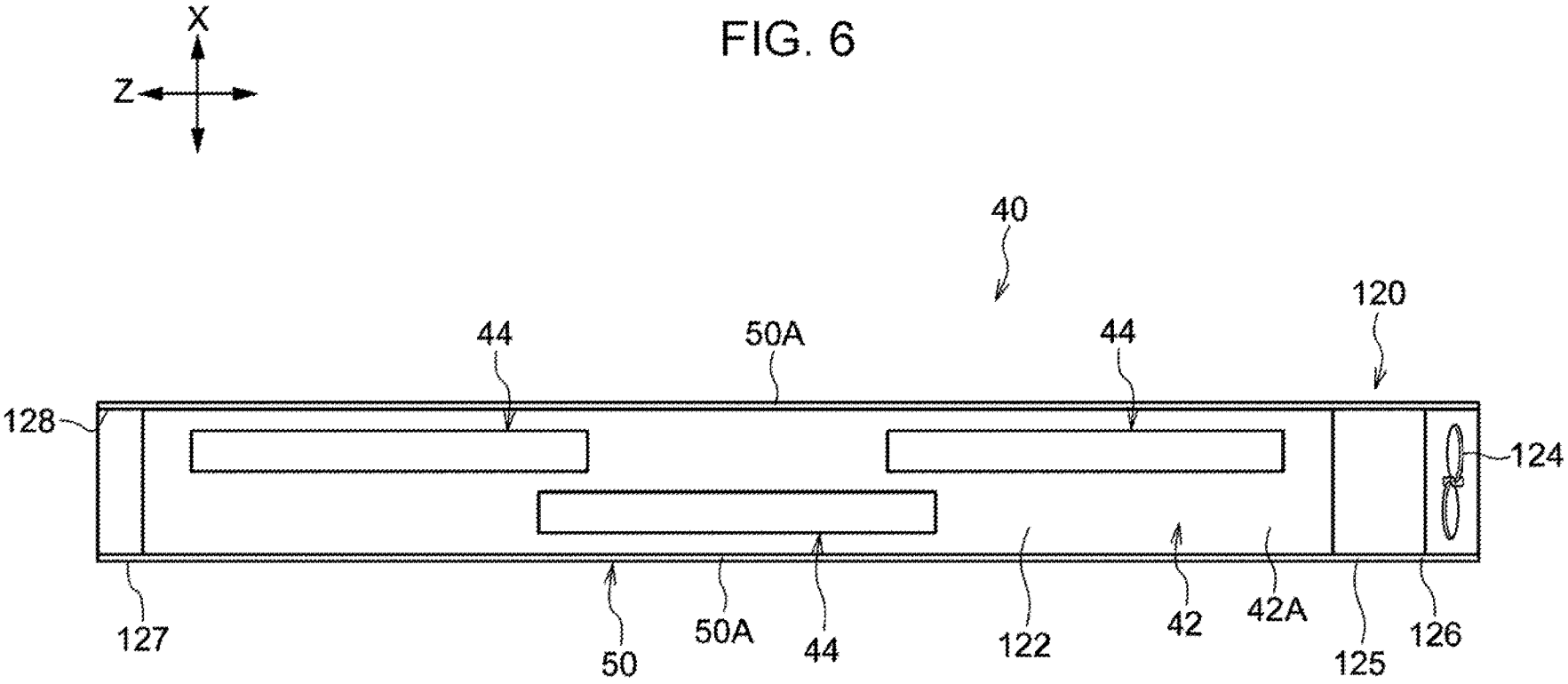
FIG. 6 is a cross-sectional view viewed in a plan of the air feeding device of the light exposure device.

In the surface of each support body 60 facing the base plate 42, a threaded hole 74 to which the shank 58B of the corresponding fastening member 58 is fastened is formed (refer to FIG. 6). The threaded hole 74 is formed at a position opposing the corresponding through-hole 84 of the base plate 42.

While the fastening members 58 are inserted into the recessed portions 82 of the base plate 42, and the shanks 58B of the fastening members 58 extend through the through-holes 84 of the base plate 42, the shanks 58B of the fastening members 58 are fastened to the threaded holes 74 of the support bodies 60 with the spacers 56 interposed therebetween. Thus, the light emitting units 44 are secured to the base plate 42 with the fastening members 58 at the inner side of the recessed portions 82 of the base plate 42. While the light emitting units 44 are secured to the base plate 42 with the fastening members 58, the spacers 56 are interposed between the base plate 42 and the support bodies 60.

As illustrated in FIG. 4, a driving substrate 72 is attached to the support body 60 of each light emitting unit 44 with attachments 70. The driving substrate 72 extends in the first direction (direction of arrow Z). The length of the driving substrate 72 in the first direction is smaller than the length of the support body 60 in the first direction (refer to FIG. 3). The driving substrate 72 is a substrate used to drive the corresponding light emitting unit 44, and formed from, for example, an application specific integrated circuit (ASIC) board.

Figure 7:
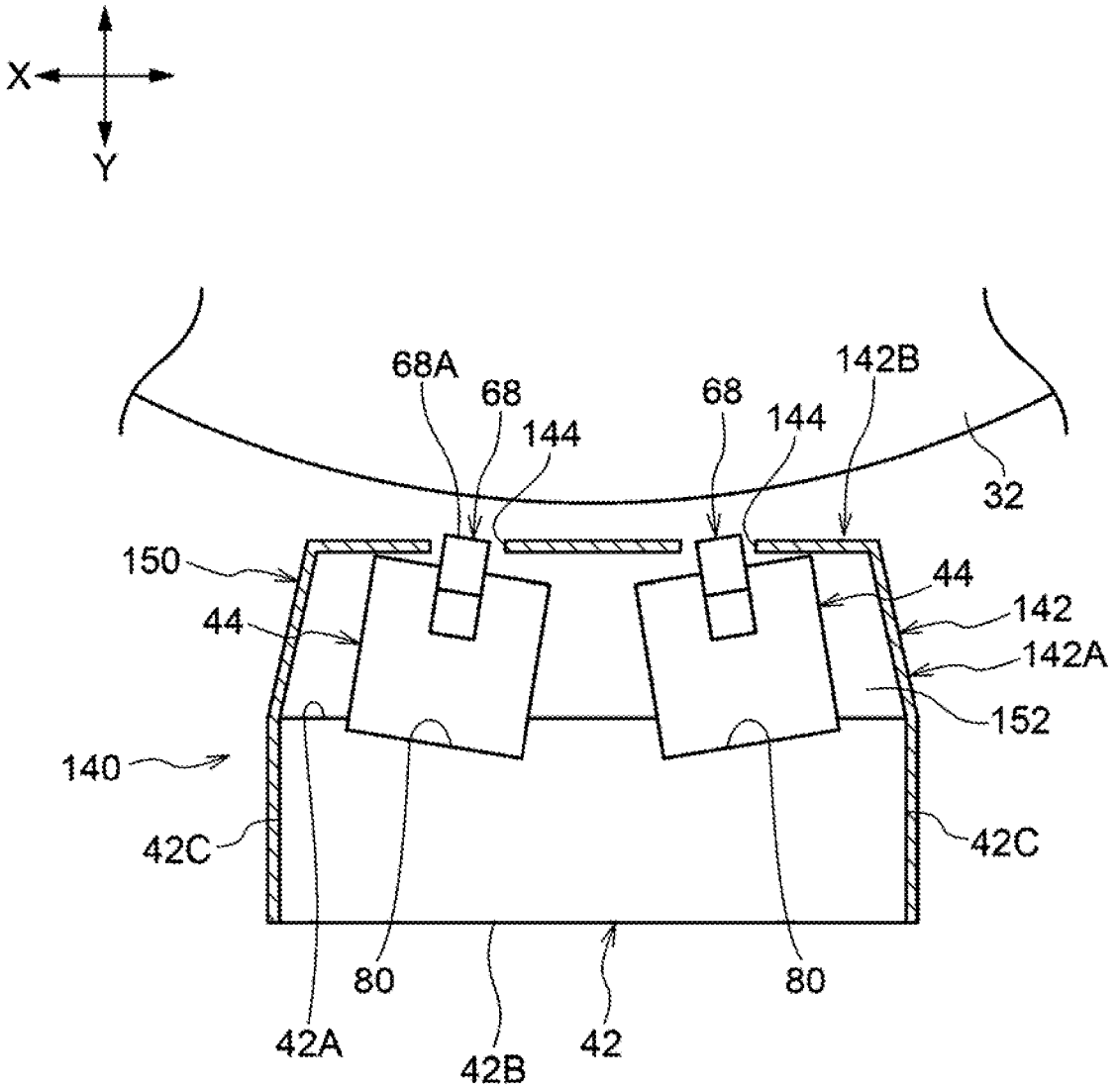
FIG. 7 is a cross-sectional view of a light exposure device according to a second exemplary embodiment taken in the cross direction.

The surface (specifically, a flat surface) of the driving substrate 72 extends along a crosswise inner side portion 60A of the support body 60, that is on the inner side in the cross direction (direction of arrow X) of the base plate 42 (refer to FIG. 7). The attachment 70 forms a gap between the inner side portion 60A of the support body 60 and the surface (flat surface) of the driving substrate 72. Specifically, the driving substrate 72 is attached to the support body 60 by the attachment 70 without directly coming into contact with the inner side portion 60A of the support body 60 in the light emitting unit 44.

The inner side portion 60A of the support body 60 is a slope inclined inward with respect to the surface 42A of the base plate 42. As in the case of the inner side portion 60A, the flat surface of the driving substrate 72 is also inclined inward with respect to the surface 42A of the base plate 42.

Each of the three light emitting units 44 includes the driving substrate 72 on the inner side portion 60A of the corresponding support body 60.

As illustrated in FIG. 3, in a side view, the driving substrate 72 disposed on one of the light emitting units 44 is disposed not to overlap the other light emitting unit adjacent to the one light emitting unit 44.

At a middle portion of the driving substrate 72 in the first direction (direction of arrow Z), a connector 104 to which a flat cable 102 is electrically connected from outside of the light emitting unit 44 is disposed. A connection port of the connector 104 is formed in the direction crossing the surface (flat surface) of the driving substrate 72. A connection portion of the flat cable 102 is insertable into and removable from the connector 104 in the direction crossing the surface (flat surface) of the driving substrate 72.

The flat cable 102 connected to the connector 104 extends from the driving substrate 72 in a direction away from the support body 60. The base plate 42 has through portions 106, which extend through in the vertical direction (direction of arrow Y), at positions corresponding to the positions where the flat cables 102 are connected to the driving substrates 72. Each through portion 106 is formed in the base plate 42 at a position on the side of the corresponding driving substrate 72 in the cross direction (direction of arrow X) of the base plate 42, and on the side opposite to the side on which the light emitting unit 44 including the driving substrate 72 is disposed (that is, on the side having no light emitting unit 44). The flat cable 102 extends through the through portion 106 of the base plate 42 to be disposed on the back surface 42B of the base plate 42. For example, on the back surface 42B of the base plate 42, a lower covering (not illustrated) that covers the flat cable 102 may be disposed.

Spacers 56

As illustrated in FIG. 4, the spacers 56 are interposed between the base plate 42 and each light emitting unit 44 in an optical axial direction of the light source 64. For example, each spacer 56 has a plate shape and is formed from a single component. In the present exemplary embodiment, each spacer 56 has a U shape when viewed in the optical axial direction of the light source 64. Each spacer 56 includes a body 56A and a depression 56B, cut out from one side of the body 56A.

Each spacer 56 is disposed on the slope 80A of the recess 80 of the base plate 42. When the spacer 56 is disposed on the slope 80A, the spacer 56 has a thickness equal to or greater than the depth of the recess 80. The fastening members 58 secure the light emitting units 44 to the base plate 42 while allowing the spacers 56 to bear compression load.

Covering 50

Figure 5:
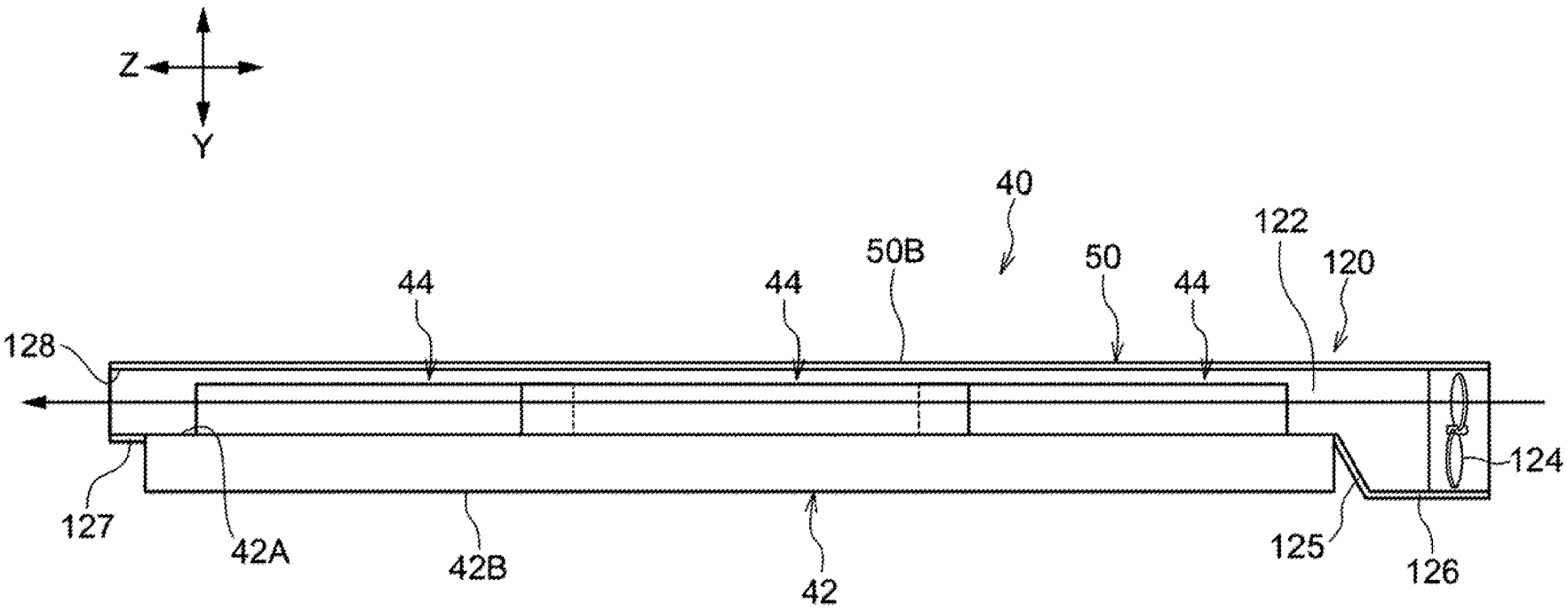
FIG. 5 is a cross-sectional view viewed sideways of an air feeding device of the light exposure device taken in the longitudinal direction.

As illustrated in FIGS. 4 to 6, the covering 50 is attached to the base plate 42 on the side of the three light emitting units 44, and forms a flow path 122 inside the covering 50 between itself and the surface 42A of the base plate 42. In a side view of the light exposure device 40 (viewed in the direction of arrow X), the covering 50 extends in the first direction (direction of arrow Z) of the base plate 42 to overlap the three light emitting units 44. The length of the covering 50 in the first direction (direction of arrow Z) is greater than the length of the base plate 42 in the first direction (refer to FIG. 5). The covering 50 is disposed to surround the entirety of the three light emitting units 44 disposed on the surface 42A of the base plate 42, and extends outward in the first direction from both end portions of the base plate 42 in the first direction.

As illustrated in FIG. 4, the covering 50 includes a pair of side walls 50A disposed at ends in the width direction crossing the first direction of the base plate 42, that is, ends in the cross direction (direction of arrow X). The covering 50 also includes a covering portion 50B, which is bent at upper end portions 51 disposed at the vertically upper portions of the pair of side walls 50A and extends inward in the width direction to cover the light emitting unit 44.

The side walls 50A are disposed to extend in the vertical direction (direction of arrow Y) at end portions of the base plate 42 in the width direction. For example, each the side wall 50A includes an upper wall 90A and a lower wall 90B. The upper wall 90A is disposed vertically above the base plate 42 and bent with respect to the lower wall 90B disposed vertically below the base plate 42. The upper wall 90A is inclined inward in the width direction of the base plate 42. The lower walls 90B of the pair of side walls 50A are in contact with both side surfaces 42C of the base plate 42 in the width direction, and attached to the side surfaces 42C of the base plate 42 with fastening members 86.

In the cross-sectional view taken in the cross direction illustrated in FIG. 4, the covering portion 50B is curved to be recessed. For example, the covering portion 50B is curved along the surface of the photoconductor drum 32. The covering portion 50B has openings 52 at positions corresponding to the lens units 68 of the light emitting units 44. In the present exemplary embodiment, the covering portion 50B has openings 52 at positions opposing the lens units 68 of the three light emitting units 44 (refer to FIG. 2). The openings 52 are rectangular, and extend along the lens units 68 in the first direction (direction of arrow Z). The length of the openings 52 in the first direction is equal to or greater than the length of the lens units 68 in the first direction.

In the light emitting units 44, light from the multiple light sources 64 passes through the openings 52 of the covering portion 50B through the lens units 68. Specifically, the openings 52 allow light from the multiple light sources 64 of the light emitting units 44 to pass therethrough without being intercepted by the covering portion 50B.

In the present exemplary embodiment, the height of the upper end portions 51 of the side walls 50A of the covering 50 in the vertical direction (direction of arrow Y) is greater than the height of lens surfaces 68A at the upper ends of the lens units 68 of the light emitting units 44. The height of the covering portion 50B at the center portion in the width direction (that is, direction of arrow X) is smaller than the height of the covering portion 50B at the end portions in the width direction (that is, upper end portions 51).

For example, the height of the openings 52 of the covering portion 50B is the same as the height of the lens surfaces 68A of the lens units 68 of the light emitting units 44. Instead, the height of the openings 52 of the covering portion 50B may be greater or slightly smaller than the height of the lens surface 68A. The height of the openings 52 of the covering portion 50B equal to or greater than the height of the lens surfaces 68A allows the covering portion 50B to protect the lens surfaces 68A, unlike in the case where the height of the openings 52 of the covering portion 50B is smaller than the height of the lens surfaces 68A.

Air Feeding Device 120

As illustrated in FIGS. 5 and 6, the air feeding device 120 includes the flow path 122, disposed inside the covering 50 between the covering 50 and the surface 42A of the base plate 42, and a fan 124, disposed at a first end of the covering 50 in the first direction (direction of arrow Z). For example, an inclined pipe portion 125 is disposed at a first end of the covering 50 in the first direction (direction of arrow Z). The inclined pipe portion 125 extends from the base plate 42 to expand obliquely downward from the surface 42A of the base plate 42. An outer end of the inclined pipe portion 125 in the first direction is connected to a rectangular pipe portion 126. The fan 124 is attached to the pipe portion 126. A pipe portion 127 is disposed at a second end of the covering 50 in the first direction (direction of arrow Z) (that is, end opposite to the fan 124). The pipe portion 127 extends from the base plate 42. At the outer end of the pipe portion 127 in the first direction, an outlet 128 through which air is discharged is formed.

The fan 124 introduces air into the flow path 122 inside the covering 50 through rotation. The rotation of the fan 124 feeds air in the first direction (direction of arrow Z) of the flow path 122.

The air feeding device 120 introduces air into the flow path 122 inside the covering 50 through rotation of the fan 124. Thus, air flows through the flow path 122 inside the covering 50 in the first direction (direction of arrow Z) toward the second end, opposite to the side where the fan 124 is disposed, and air is discharged through the outlet 128. The flow path 122, disposed to surround the three light emitting units 44, cools the three light emitting units 44 by allowing air to pass therethrough in the first direction.

Operations and Effects

The operations and effects of the present exemplary embodiment will be described.

The light exposure device 40 includes the base plate 42 formed from a metal block extending in the first direction (direction of arrow Z), and the three light emitting units 44 each including the support body 60 extending in the first direction and the multiple light sources 64 (refer to FIG. 6) arranged in the first direction and supported by the support body 60.

In the light exposure device 40, the base plate 42 extends throughout in the axial direction of the photoconductor drum 32. The three light emitting units 44 are arranged while being shifted from each other in the first direction of the base plate 42. At least one of the three light emitting units 44 opposes an area of the photoconductor drum 32 over which the photoconductor is disposed in the axial direction. The light exposure device 40 applies light from the light emitting units 44 to the photoconductor drum 32 to form an electrostatic latent image over the area of the photoconductor drum 32 where the photoconductor is disposed.

In the light exposure device 40, the three light emitting units 44 are arranged on the base plate 42 while being shifted from each other in the first direction (direction of arrow Z). The length of the base plate 42 in the first direction (direction of arrow Z) is greater than the length of each of the light emitting units 44 in the first direction (direction of arrow Z).

As described above, in the structure where multiple light emitting units are disposed on a base plate, the driving substrates respectively disposed on the multiple light emitting units generate more heat, and may degrade image quality due to thermal expansion of each component.

In the light exposure device 40 according to the present exemplary embodiment, the covering 50 is disposed to surround the three light emitting units 44 facing the surface 42A of the base plate 42, and the flow path 122 is formed inside the covering 50. Rotation of the fan 124 introduces air into the flow path 122 to allow air to flow through the flow path 122 in the first direction (direction of arrow Z). Thus, the three light emitting units 44 inside the flow path 122 are cooled by air. Compared to the structure that does not allow air to flow around the three light emitting units 44, the light exposure device 40 reduces degradation of image quality due to expansion of each component with heat of the light emitting units 44.

In the light exposure device 40, the flow path 122 through which air flows in the first direction is disposed on the surface 42A of the base plate 42 to surround the light emitting units 44. Compared to the structure including a flow path disposed on the outer side of the base plate in the width direction, the light exposure device 40 has a smaller dimension in the width direction.

In the light exposure device 40, the covering 50 is attached to the base plate 42 on the side of the light emitting units 44. The covering 50 forms the flow path 122 between itself and the surface 42A of the base plate 42. Thus, in the light exposure device 40, the covering 50 is easily attachable than in the structure where a covering is attached to the light emitting unit.

In the light exposure device 40, the covering 50 is disposed to overlap the three light emitting units 44 in a side view. Compared to the structure where part of multiple light emitting units is exposed through the covering in a side view, the light exposure device 40 more efficiently cools the three light emitting units 44 with air.

In the light exposure device 40, the covering 50 includes the side walls 50A, disposed on ends of the base plate 42 in the width direction, and the covering portion 50B, covering the surface of the light emitting units 44 opposite to the surface facing the base plate 42. The covering portion 50B has the openings 52 through which light from the multiple light sources 64 of the light emitting units 44 passes. Compared to the structure where the covering includes only the side walls at ends of the base plate in the width direction, the light exposure device 40 more efficiently flows air in the first direction (direction of arrow Z).

In the light exposure device 40, the height of the side walls 50A of the covering 50 is greater than the height of the lens surfaces 68A at the upper ends of the lens units 68 of the light emitting units 44, and the center portion of the covering portion 50B in the width direction is lower than the end portions of the covering portion 50B in the width direction. Thus, compared to the structure where the covering portion is horizontal, the covering in the light exposure device 40 is less likely to interfere with the photoconductor drum 32, serving as a light irradiation target. Compared to the structure where the covering portion is horizontal, powder such as toner less easily adheres to the lens surfaces 68A in the light exposure device 40.

In the light exposure device 40, the base plate 42 is formed from a metal block. Compared to the structure where the base plate is formed from sheet metal, the light exposure device 40 improves heat dissipation from the three light emitting units.

In the light exposure device 40, the support bodies 60 of the light emitting units 44 are formed from metal blocks. Compared to the structure where the support bodies are formed from resin, the light exposure device 40 improves heat dissipation from the three light emitting units 44 to the base plate 42.

In the light exposure device 40, each light-emitting-device substrate 62 is disposed on the surface of the corresponding support body 60 opposite to the surface facing the base plate 42, and the multiple light sources 64 are disposed on the light-emitting-device substrate 62. Compared to the structure where light emitting devices are spaced apart from the surface of the support body, the light exposure device 40 improves heat dissipation from the light-emitting-device substrate 62.

The image forming apparatus 10 includes the light exposure device 40 and the photoconductor drum 32, which moves relative to the light exposure device 40 in the direction crossing the first direction (Z direction) and is irradiated with light from the light exposure device 40. The surface of the photoconductor drum 32 has an area over which a photosensitive material is disposed. Thus, compared to the structure including a flow path disposed on the outer side of the base plate of the light emitting unit in the width direction, the image forming apparatus 10 reduces its entire size.

In the image forming apparatus 10, the area over which the photosensitive material is disposed is located on the surface of the photoconductor drum 32, which is a cylindrical member rotating in the circumferential direction. The image forming apparatus 10 including the photoconductor drum 32 reduces its entire size compared to the structure including a flow path disposed on the outer side of the base plate of the light emitting unit in the width direction.

Second Exemplary Embodiment

A light exposure device according to a second exemplary embodiment will now be described. In the second exemplary embodiment, components or portions the same as those of the first exemplary embodiment are denoted with the same reference signs without detailed description, and different points will be described.

Figure 8:
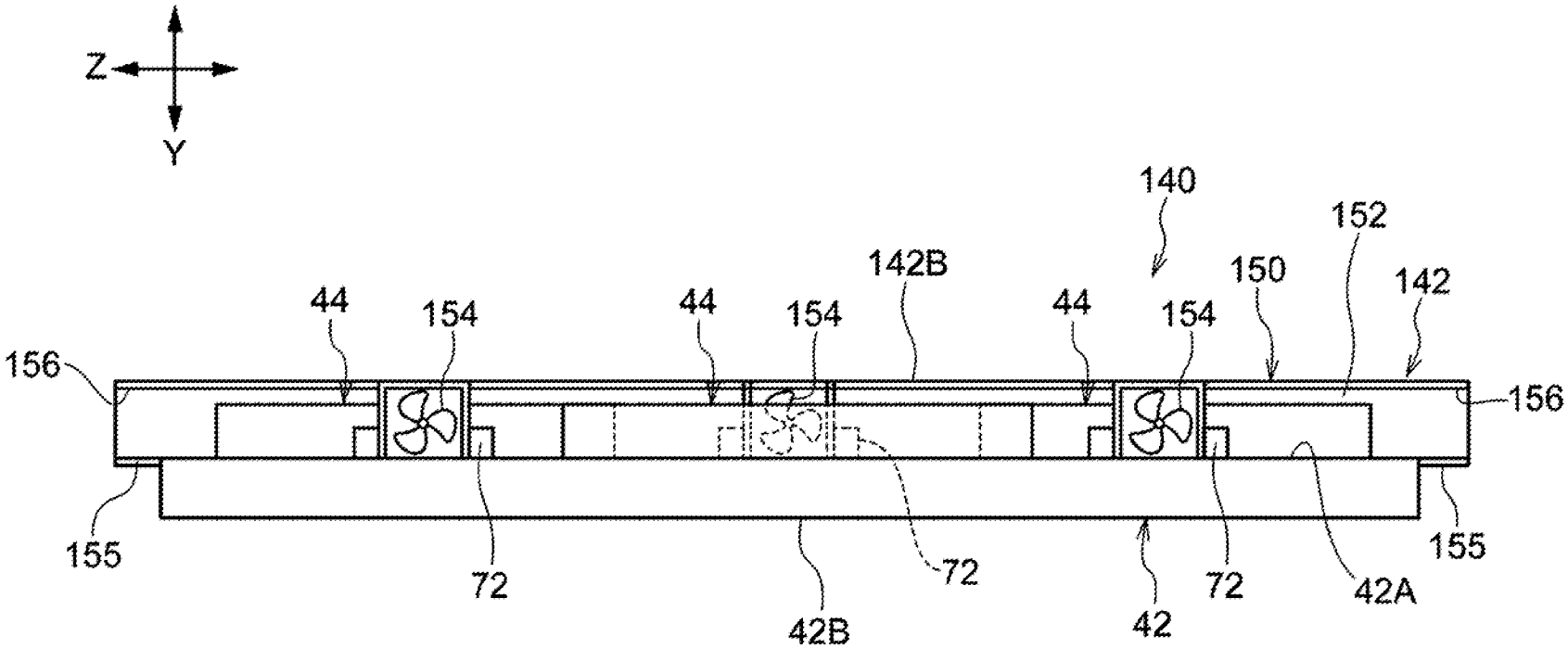
FIG. 8 is a cross-sectional view viewed sideways of an air feeding device of the light exposure device according to the second exemplary embodiment taken in the longitudinal direction.
Figure 9:
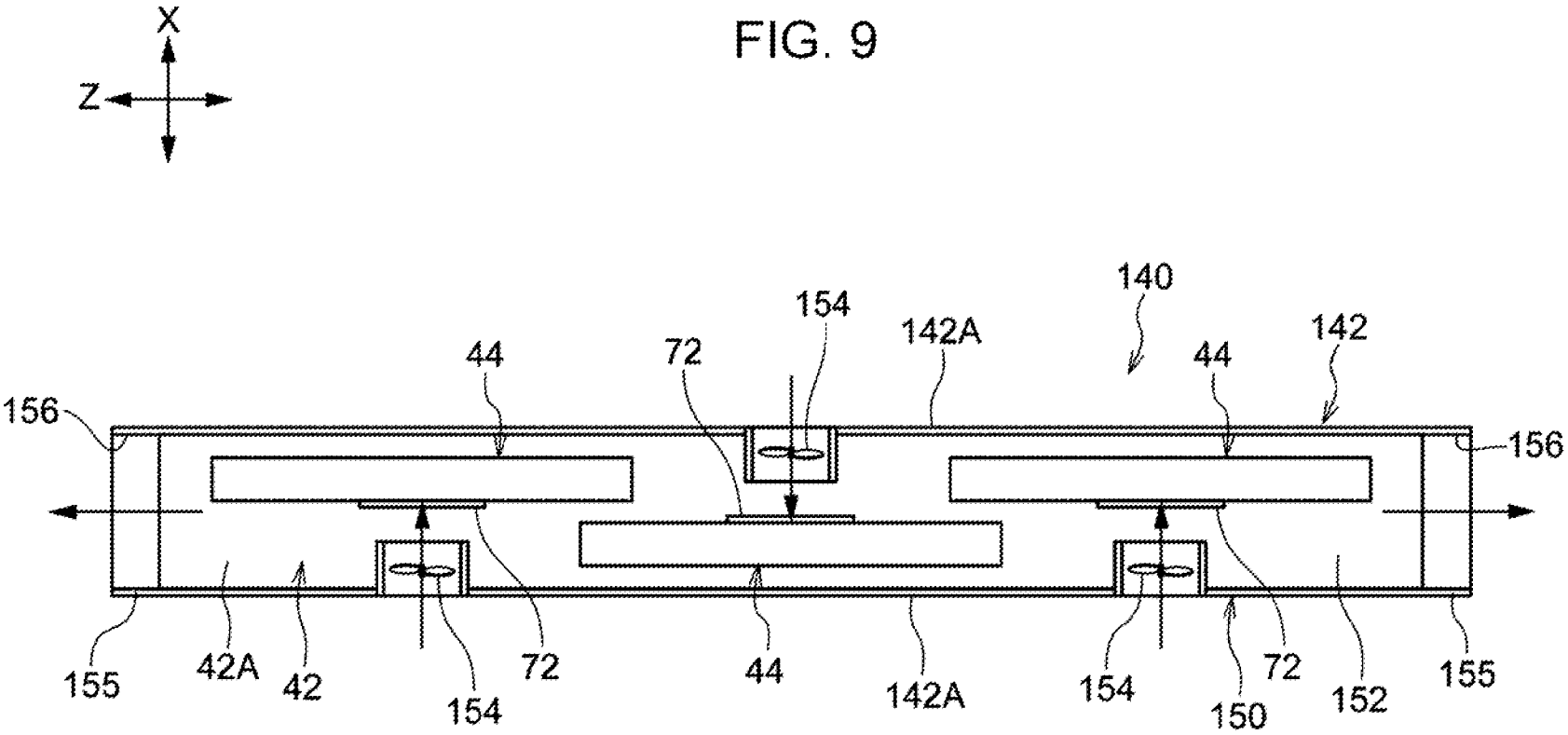
FIG. 9 is a cross-sectional view viewed in a plan of the air feeding device of the light exposure device according to the second exemplary embodiment.

FIG. 7 is a cross-sectional view of a light exposure device 140 according to a second exemplary embodiment taken in the cross direction. FIG. 8 is a cross-sectional view of the light exposure device 140 according to the second exemplary embodiment taken in the longitudinal direction and viewed sideways. FIG. 9 is a cross-sectional view of the light exposure device 140 according to the second exemplary embodiment viewed in a plan. As illustrated in FIG. 7 to FIG. 9, the light exposure device 140 includes a covering 142, disposed to surround the three light emitting units 44 on the surface 42A of the base plate 42, and an air feeding device 150, which feeds air to a flow path 152 inside the covering 142 in the first direction (direction of arrow Z). The light exposure device 140 differs from the light exposure device 40 according to the first exemplary embodiment in terms of only the covering 142 and the air feeding device 150, and other components are the same. FIG. 7 to FIG. 9 are schematic diagrams to clarify the structure of the light exposure device 140.

When the light exposure device 140 is viewed from a side (viewed in the direction of arrow X), the covering 142 extends in the first direction of the base plate 42 to overlap the three light emitting units 44 (refer to FIGS. 8 and 9). The length of the covering 142 in the first direction (direction of arrow Z) is greater than the length of the base plate 42 in the first direction.

As illustrated in FIG. 7, the covering 142 includes a pair of side walls 142A disposed at end portions in the width direction crossing the first direction (direction of arrow Z) of the base plate 42, that is, at end portions in the cross direction (direction of arrow X). The covering 142 also includes a covering portion 142B, which extends inward in the width direction from the upper end portions of the pair of side walls 142A and covers the light emitting units 44.

The side walls 142A extend in the vertical direction (direction of arrow Y) at ends of the base plate 42 in the width direction. For example, each of the side walls 142A has an upper wall, which is disposed vertically above the base plate 42 and curved with respect to the lower wall. The upper wall is inclined inward in the width direction of the base plate 42. Lower end portions of the pair of side walls 142A are attached to the side surfaces 42C of the base plate 42 with fastening members not illustrated.

In the present exemplary embodiment, the covering portion 142B has a flat shape. For example, the flat surface of the covering portion 142B extends in the horizontal direction. The covering portion 50B includes openings 144 at positions opposing the lens units 68 of the three light emitting units 44. The openings 144 are rectangular and arranged along the lens units 68 in the first direction (direction of arrow Z). Thus, light emitted from the multiple light sources 64 and transmitted through the lens units 68 passes through the openings 144 of the covering portion 142B.

In the present exemplary embodiment, the height of the openings 144 of the covering portion 142B is the same as the height of the lens surfaces 68A at the upper ends of the lens units 68. Instead, the height of the openings 144 of the covering portion 142B may be slightly lower or higher than the height of the lens surfaces 68A.

As illustrated in FIGS. 8 and 9, the air feeding device 150 includes a flow path 152 formed inside the covering 142 between the covering 142 and the surface 42A of the base plate 42, and three fans 154 disposed at positions on the side walls 142A of the covering 142 opposing the three light emitting units 44. Pipe portions 155 extending from both ends of the base plate 42 in the first direction are disposed at both ends of the covering 142 in the first direction (direction of arrow Z). At outer ends of each pipe portion 155 in the first direction, outlets 156 through which air is discharged are formed. In the present exemplary embodiment, the fans 154 are disposed at positions opposing the driving substrates 72 on the inner side portions of the light emitting units 44 in the width direction.

In the air feeding device 150, the three fans 154 rotate to introduce air into the flow path 152 inside the covering 142. In the present exemplary embodiment, the fans 154 are disposed at positions opposing the driving substrates 72 on the light emitting units 44, and blow air toward the driving substrates 72 on the light emitting units 44. Air flows through the flow path 152 inside the covering 142 in both positive and negative directions of the first direction (direction of arrow Z), and is discharged from the outlets 156 at both ends of the flow path 152 in the first direction.

The light exposure device 140 has the following operations and effects besides the similar operations and effects of the light exposure device 40 according to the first exemplary embodiment.

In the light exposure device 140, the fans 154 are disposed at positions opposing the driving substrates 72 on the light emitting units 44, and the fans 154 rotate to blow air toward the driving substrates 72 on the light emitting units 44. Compared to the structure where the fans are disposed at positions opposing a surface of the light emitting unit opposite to the surface on which the driving substrate is disposed, the light exposure device 140 efficiently cools the driving substrates 72.

In the light exposure device 140 according to the second exemplary embodiment, the covering portion 142B of the covering 142 is flat. However, as in the case of the light exposure device 40 according to the first exemplary embodiment, the covering portion 142B may be curved to be recessed along the surface of the photoconductor drum 32.

Third Exemplary Embodiment

Figure 10:
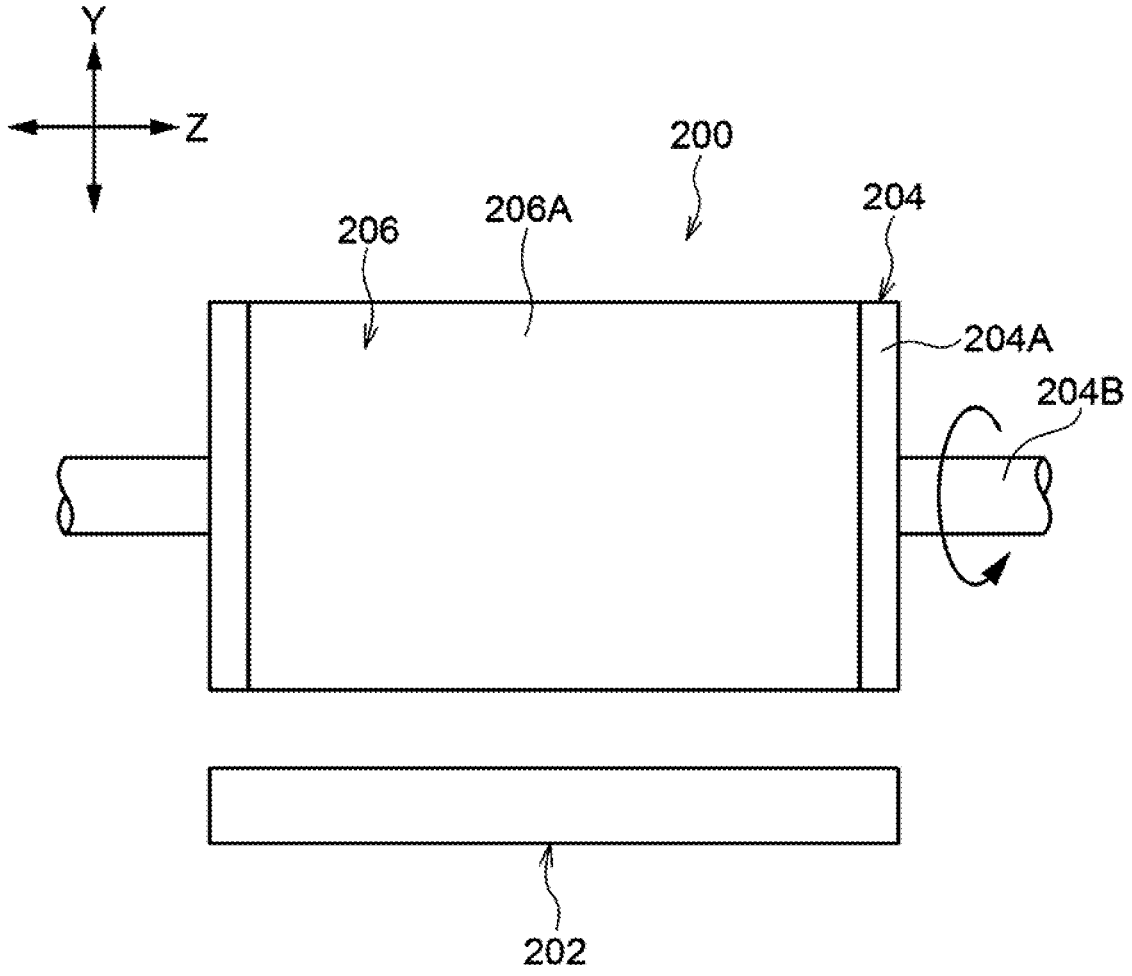
FIG. 10 is a diagram of a structure of a rendering device including a light emitting device according to a third exemplary embodiment.

FIG. 10 illustrates a rendering device 200 according to a third exemplary embodiment including a light emitting device 202. Components the same as those of the first exemplary embodiment are denoted with the same reference signs without description.

As illustrated in FIG. 10, the rendering device 200 includes the light emitting device 202 and a cylindrical member 204, which extends in the longitudinal direction of the light emitting device 202 and rotates in the circumferential direction.

The light emitting device 202 has the same structure as the light exposure device 40 according to the first exemplary embodiment.

The cylindrical member 204 includes a cylindrical portion 204A and a shaft 204B extending from both sides of the cylindrical portion 204A. The shaft 204B is rotatably supported by a frame, not illustrated. When the shaft 204B rotates, the cylindrical portion 204A rotates in the circumferential direction.

A substrate 206 is attached to the surface of the cylindrical portion 204A. The surface of the substrate 206 has an area 206A over which a photosensitive material is disposed. The substrate 206 is a plate for computer-to-plate (CTP) used in, for example, plate-making in offset printing. The area 206A over which a photosensitive material is disposed is, for example, an area over which a photosensitive material such as a photoresist is applied.

In the rendering device 200, while the cylindrical member 204 is being rotated, the light emitting device 202 irradiates the area 206A of the substrate 206 over which the photosensitive material is disposed with light of a predetermined pattern. Thus, the predetermined pattern is rendered over the area 206A of the substrate 206 over which the photosensitive material is disposed. Thereafter, the substrate 206 is developed to form a printing plate used in an offset printer. Examples usable as a light source of the rendering device 200 include a laser device.

The light emitting device 202 has the following operations and effects besides the similar operations and effects of the light exposure device 40 according to the first exemplary embodiment.

Compared to the structure including a flow path disposed on the outer side of the base plate of the light emitting unit in the width direction, the rendering device 200 including the light emitting device 202 reduces its entire size.

Compared to the structure including a flow path disposed on the outer side of the base plate of the light emitting unit in the width direction, the rendering device 200 including the cylindrical member 204 reduces its entire size.

In the rendering device 200, instead of the light exposure device 40 according to the first exemplary embodiment, the light emitting device 202 may have the same structure as the light exposure device 140 according to the second exemplary embodiment.

SUPPLEMENTARY EXPLANATION

The light exposure device according to each of the first and second exemplary embodiments and the light emitting device according to the third exemplary embodiment include three light emitting units on the base plate. However, the present disclosure is not limited to this structure. For example, one, two, four, or more light emitting units may be disposed on the base plate. The positions of multiple light emitting units disposed on the base plate may be determined as appropriate.

In the light exposure device according to each of the first and second exemplary embodiments and the light emitting device according to the third exemplary embodiment, the base plate is formed from a metal block. However, the present disclosure is not limited to this structure. The material or shape of the base plate may be changed. For example, the base plate may be formed from resin, or other metal such as sheet metal. Components of the light emitting unit or the shapes of the components of the light emitting unit may be changed. The support body of the light emitting unit is formed from a metal block. However, the present disclosure is not limited to this structure. The material or shape of the support body may be changed. For example, the support body may be formed from resin, or other metal such as sheet metal.

In the light exposure device according to each of the first and second exemplary embodiments and the light emitting device according to the third exemplary embodiment, the flow path is disposed to surround the entirety of the three light emitting units 44, but may be disposed to surround at least part of the light emitting units. The shape of the covering forming the flow path may be changed. For example, the covering may have a trapezoidal, rectangular, or dome shape. For example, the covering may have a bent portion that is in contact with the surface of the base plate and may be attached to the surface of the base plate with the bent portion.

In the light exposure device according to each of the first and second exemplary embodiments and the light emitting device according to the third exemplary embodiment, the fan/fans introduces/introduce air into the flow path to flow air in the first direction. However, the present disclosure is not limited to this structure. For example, the fan/fans may suck air to flow air in the first direction of the flow path.

The rendering device 200 according to the third exemplary embodiment irradiates the substrate 206 attached to the cylindrical portion 204A of the cylindrical member 204 with light from the light emitting device 202. However, the present disclosure is not limited to this structure. For example, light may be applied from the light emitting device to the substrate disposed on a flat table, while the light emitting device and the table are moved relative to each other in the direction crossing the first direction of the light emitting device.

In the rendering device 200 according to the third exemplary embodiment, the substrate 206 is a plate for CTP for plate-making in offset printing. Light is applied from the light emitting device 202 to the area 206A of the substrate 206 over which the photosensitive material is disposed. However, the present disclosure is not limited to this structure. For example, the light emitting device and the rendering device are usable for light exposure for manufacturing a printed wiring board (PWB). For example, a printed wiring board may be manufactured without using a photomask with direct rendering on the substrate to which a photosensitive material such as a photoresist is applied. The substrate may be a rigid circuit board or a flexible circuit board. When a flexible circuit board is used, the flexible circuit board may be subjected to rendering while being rotated and fixed to the cylindrical member 204 illustrated in FIG. 10.

The above light emitting device and rendering device are usable for the purposes to which photolithography is applicable, such as forming a color filter in the process of manufacturing a liquid crystal display (LCD), light exposure of a dry film resist (DFR) in the process of manufacturing a thin film transistor (TFT), light exposure of a dry film resist (DFR) in the process of manufacturing a plasma display panel (PDP), light exposure of a photosensitive material such as a photoresist in the process of manufacturing a semiconductor device, light exposure of a photosensitive material such as a photoresist in the process of plate-making for printing other than offset printing such as gravure printing, and light exposure of a photosensitive material in the process of manufacturing timepiece components. Here, photolithography refers to a technology involving light exposure of the surface of a member on which the photosensitive material is disposed into a pattern, to generate a pattern including an exposed portion and an unexposed portion.

The above light emitting device and rendering device are applicable to a photon-mode photosensitive material, on which information is directly recorded with light exposure, and a heat-mode photosensitive material, on which information is recorded with heat generated by light exposure. Examples usable as a light source of the rendering device 200 include an LED or a laser device depending on a target subjected to light exposure.

The present disclosure has been described in detail using specific exemplary embodiments, but is not limited to these exemplary embodiment. It is obvious for persons having ordinary skill in the art that the exemplary embodiments may be modified in various manners within the scope of the present disclosure.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A light emitting device, comprising:

a base plate extending in a first direction;

a plurality of light emitting units arranged on a surface of the base plate while being shifted from each other in the first direction, wherein each one of the plurality of light emitting units includes:

a support body extending in the first direction; and a plurality of light sources supported on the support body while being arranged in the first direction; and a flow path disposed over the surface of the base plate to surround at least part of the light emitting units and allowing air to flow therethrough in the first direction, wherein a covering forming the flow path between the covering and the surface of the base plate is attached to the base plate beside the plurality of light emitting units, and wherein the covering includes:

a side wall disposed at an end of the base plate in a width direction crossing the first direction;

a covering portion covering a surface of the light emitting units opposite to a surface facing the base plate; and an opening formed in the covering portion to allow light from the plurality of light sources to pass therethrough.

2. The light emitting device according to claim 1, wherein the covering is disposed at a position overlapping the plurality of light emitting units in a side view.

3. The light emitting device according to claim 1, wherein each of the light emitting units includes a lens surface configured such that light from the plurality of light sources may pass through the lens surface, and wherein a height of the side wall is greater than a height of the lens surface, and a height of a middle portion of the covering portion in a width direction is smaller than a height of an end portion of the covering portion in the width direction.

4. The light emitting device according to claim 1, wherein the base plate is formed from a metal block.

5. The light emitting device according to claim 2, wherein the base plate is formed from a metal block.

6. The light emitting device according to claim 3, wherein the base plate is formed from a metal block.

7. The light emitting device according to claim 1, wherein the support body is formed from a metal block.

8. The light emitting device according to claim 2, wherein the support body is formed from a metal block.

9. The light emitting device according to claim 7, wherein each of the light emitting units includes a light emitting device on a surface of the support body opposite to a surface facing the base plate.

10. A rendering device, comprising:

the light emitting device according to claim 1; and an area over which a photosensitive material configured to be irradiated with light by the light emitting device is disposed, the area being configured to move relative to the light emitting device in a direction crossing the first direction.

11. The rendering device according to claim 10, wherein the area is disposed on a surface of a cylindrical member configured to rotate in a circumferential direction.

* * * * *